United States Patent [19]

Malaval

[11] Patent Number: 4,469,051

[45] Date of Patent: Sep. 4, 1984

[54] EMERGENCY SHUT-OFF DEVICE, IN CASE OF LEAKAGE OF A STEAM GENERATOR TUBE

[75] Inventor: Claude Malaval, Antony, France

[73] Assignee: Novatome, Le Plessis Robinson, France

[21] Appl. No.: 472,816

[22] Filed: Mar. 7, 1983

[30] Foreign Application Priority Data

Mar. 31, 1982 [FR] France ..... 82 05542

[51] Int. Cl.[3] ..... F22B 37/44

[52] U.S. Cl. ..... 122/507; 122/32; 122/504; 165/134 R; 376/277

[58] Field of Search ..... 122/504, 32, 507, DIG. 15; 126/35; 137/68 R, 456, 460; 165/134; 376/277, 281, 283

[56] References Cited

U.S. PATENT DOCUMENTS

| | | | |
|---|---|---|---|
| 3,294,934 | 12/1966 | Norris et al. | 122/504 |
| 3,350,277 | 10/1967 | Costes | 376/277 |
| 3,583,479 | 6/1971 | Taylor et al. | 165/134 |
| 3,713,969 | 1/1973 | Cahill, Jr. | 376/281 |
| 3,924,675 | 12/1975 | Essebaggers | 165/134 |
| 4,238,290 | 12/1980 | Schabert et al. | 376/277 |
| 4,311,189 | 1/1982 | Robin | 122/32 |

*Primary Examiner*—Edward G. Favors
*Assistant Examiner*—Steven E. Warner
*Attorney, Agent, or Firm*—Pollock, Vande Sande & Priddy

[57] ABSTRACT

The invention relates to an emergency shut-off device, in the case of leakage, of a tube of a steam generator where the heat of vaporization is contributed by a liquid metal circulating in contact with the outer surface of the tube. The device includes on the terminal portion of the tube connected to the water supply device a tubular bush interposed in the path of the feed water. The bush contains a valve connected to the bush by a rupture part. The breakage of the part under the effect of an increased flow of water, in the case of a leakage, enables the closing of the outlet of the bush. The device includes also, in the terminal portion of the tube connected to the steam collector a bush containing a free valve enabling the steam outlet to be closed in the case of a leakage in the tube. The invention is applied in particular to steam generators of fast breeder nuclear reactors cooled by liquid sodium.

6 Claims, 9 Drawing Figures

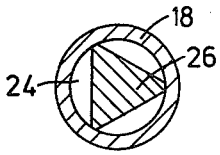
FIG. 2b
FIG. 2a
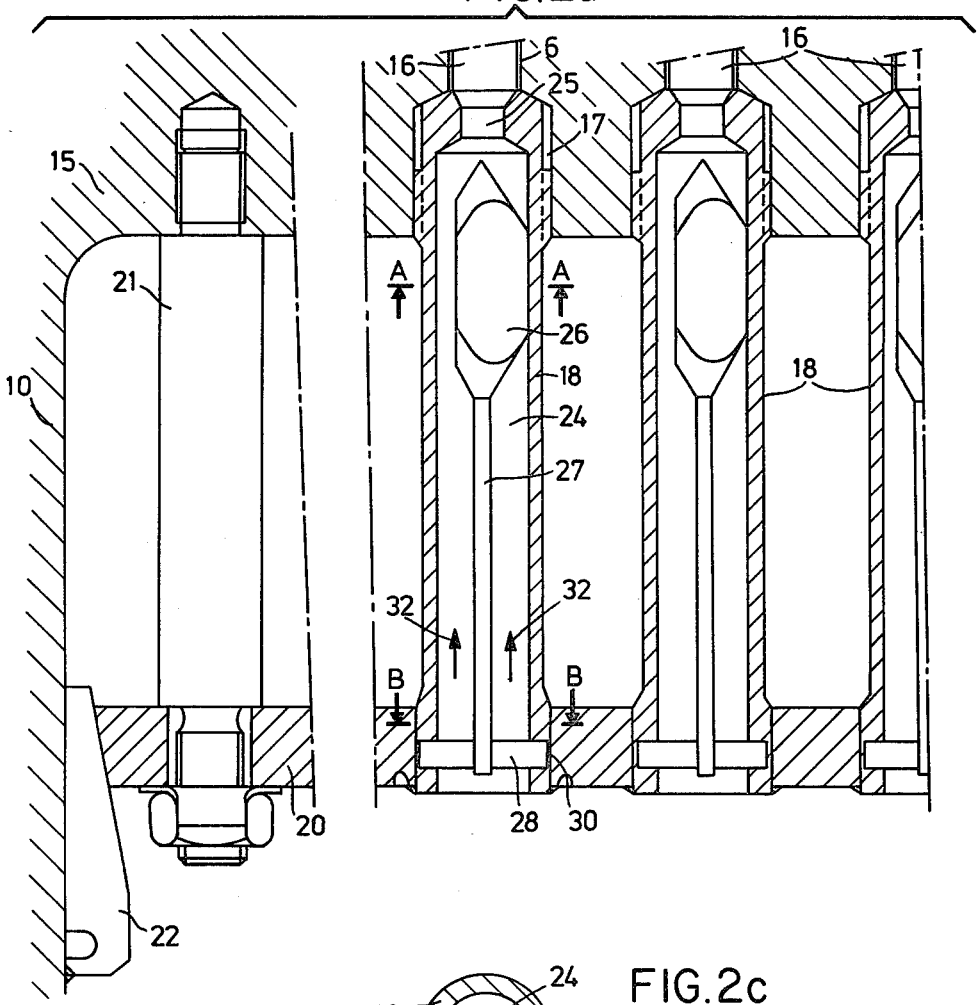
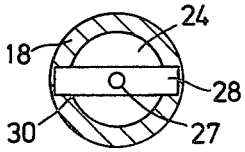
FIG. 2c

EMERGENCY SHUT-OFF DEVICE, IN CASE OF LEAKAGE OF A STEAM GENERATOR TUBE

FIELD OF THE INVENTION

The invention relates to an emergency shut-off device, in the case of leakage of a tube of a steam generator comprising a jacket enclosing a tube bundle, within which flows a liquid metal in contact with the outer surface of the tubes of the bundle.

BACKGROUND OF THE INVENTION

Such steam generators, where the heat of vaporization is applied to the feed water by a liquid metal, for example liquid sodium, are used in fast breeder nuclear reactors, the liquid metal being itself heated by another liquid metal cooling the core of the reactor.

The hot liquid sodium is generally led to the upper part of the jacket of the steam generator and flows vertically through the tube bundle.

Each of the tubes of the bundle is connected at one of its ends to a water supply device and at its other end to a collector collecting the steam formed in the tube by heat exchange between the liquid sodium and the feed water flowing in the tube. The water feed device and the steam collector may be constituted by several cylindrical boxes or by toric ducts.

In the case where toric ducts are used, it is known, for example through French Pat. No. 2,449,260, to have a T-connector on each of the tubes, in its terminal part, in the vicinity of its junction point with the toric duct. Such a T-connector enables, in particular, access to be provided to the inside part of the tubes, to carry out checks or measurements.

In such steam generators, it is necessary to limit the consequences of an accident arising from a leakage or a rupture at a tube of the bundle.

In fact, in this case, the water flowing in the tube comes into contact with the liquid sodium and an extremely vigorous chemical reaction ensues. This sodium-water reaction is manifested by two effects: a very short term effect due to the rapid rise in pressure of the hydrogen bubble produced by the reaction, and a second longer term effect arising from the movements of the liquid mass through the pipes of the secondary sodium circuit, under the thrust of the pressurized hydrogen bubble.

The first effect, of very short term, results in the propagation, at the speed of sound, through the steam generator and the pipes of the secondary circuit, of a pressure wave. To provide against this short term effect, it has been proposed to create free surfaces at the upper part of the steam generator or in the tanks situated in the secondary circuit or at different places in the steam generator. Such free surfaces are created by introducing argon into the jacket of the steam generator or into a tank within this steam generator or arranged in the secondary circuit and containing liquid sodium.

During its propagation, the pressure wave is attenuated when it encounters such free surfaces.

There is also arranged at the bottom part of the steam generator, a manifold normally closed by a rupture diaphragm and communicating with one or several rapid drainage tanks for the sodium and the products of the sodium water reaction.

However, the existence of free argon-sodium surfaces results in oscillatory phenomenon in the liquid sodium columns and in the appearance of considerable overpressures by compression of the covering argon present above these free levels.

In addition, if the sodium-water reaction is prolonged, water continuing to pour into the jacket of the steam generator, the drainage flow rate may become insufficient to avoid a rise in pressure of the steam generator and of the secondary circuit.

Finally, the extremely high flow rates which then traverse the various branches of the secondary circuit create at the terminals of the apparatus located in this circuit extremely high pressure drops and resulting in the destruction of the equipment of the secondary circuit.

Warning signals generated at the time of appearance of the leakage in the tube bundle of the generator actuate rapid decompression valves for the steam as well as stop valves for the feed water delivery to the steam generator.

However, some tens of seconds elapse before the generator is completely isolated and decompressed. This reaction time is excessive, in the case of a leakage corresponding, for example, to the total rupture of a tube, since the amount of water which passes into the liquid sodium is then considerable which results in a very high excess pressure in the secondary circuit and considerable pollution of this circuit.

SUMMARY OF THE INVENTION

It is therefore an object of the invention to provide an emergency shut-off device in the case of leakage of a tube of a steam generator comprising a jacket containing a tube bundle, within which a liquid metal flows in contact with the outer surface of the tube bundle and contributes the heat of vaporization to the feed water flowing in each of the tubes of which the two terminal portions traverse the jacket and are connected, one to a feed water device and the other to a collector collecting the steam formed in the tube, arranged outside the jacket, this shut-off device having to enable the introduction into the liquid metal of a large amount of water to be avoided, in the case of leakage or of rupture of a tube of the steam generator.

Accordingly, it comprises:

on the terminal portion of the tube connected to the water feed device, a tubular bush interposed in the path of the feed water, between the feed device and the portion of the tube entering the jacket, comprising inlet and outlet apertures for the water and containing a valve connected to the bush by a part which can be broken in the case of a leakage in the tube manifested by an increased water flow through the bush, this valve then being driven into a position of closing the feed water outlet of the bush, and in the terminal portion of the tube connected to the steam collector, a second tubular bush interposed in the path of the steam between the steam generator jacket and the steam collector, comprising inlet and outlet apertures for the steam and containing a valve free and movable in the bore of the bush, between an open position wherein the valve is placed between two sets of apertures for the passage of the steam communicating with the steam collector and a closed position of the inlet aperture for the steam in the bush, by displacement under the effect of the pressure difference appearing between the inner space of the steam collector and the inside of the bush, in the case of a leakage in the tube.

In order to understand the invention more fully, there will now be described, by way of non-limiting example, two embodiments of an emergency shut-off device according to the invention in the case of a steam generator of a fast breeder nuclear reactor of which the secondary fluid is liquid sodium.

FIG. *2a* shows a view in section of the portion of the shut-off device arranged at the level of a water box of the steam generator.

FIG. *2b* shows a sectional view along the line AA of FIG. *2a*.

FIG. *2c* shows a sectional view along the line BB of FIG. *2a*.

FIG. *3a* shows a sectional view of the portion of the shut-off device arranged at the level of the steam collector.

FIG. *3b* shows a sectional view along the line CC of FIG. *3a*.

Figure 4:
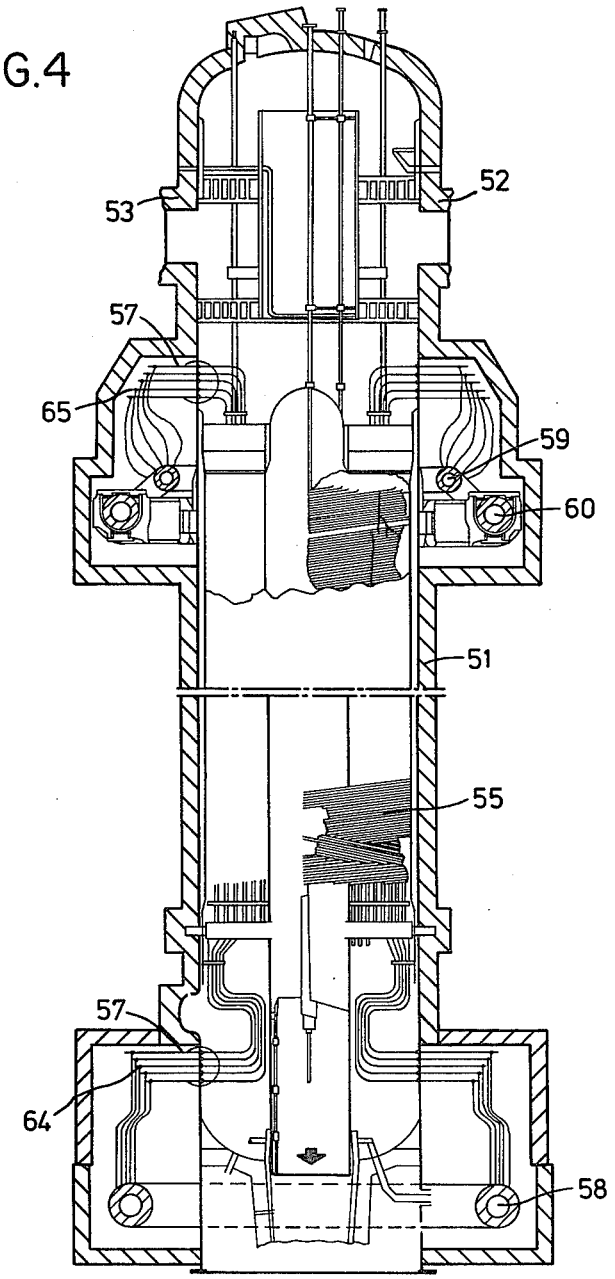

FIG. 4 is a sectional view through a vertical plane of symmetry of a steam generator comprising toric collectors for feed water and steam recovery.

Figure 5:
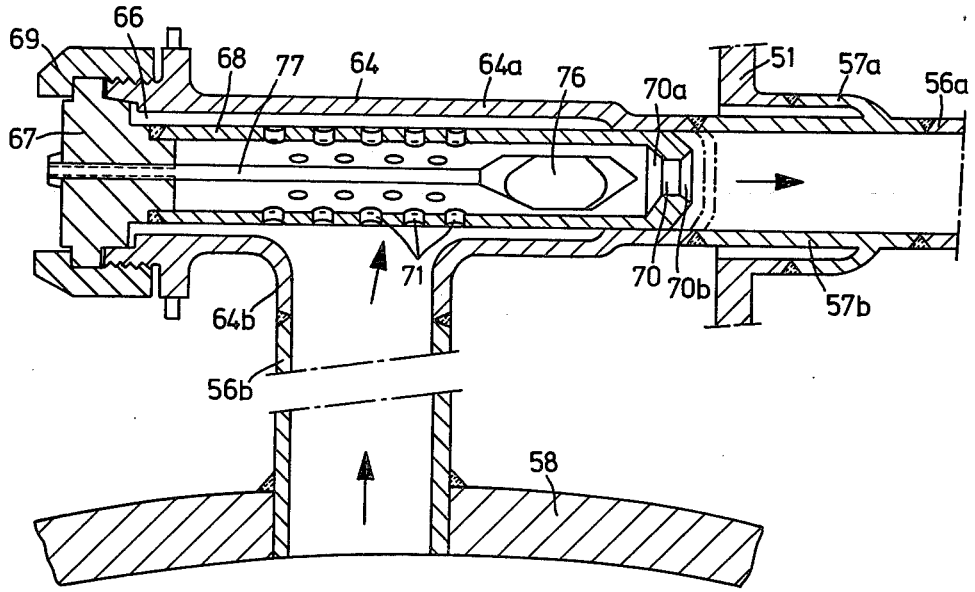

FIG. 5 is a sectional view of the part of the shut-off device associated with a terminal portion of a tube connected to the feed water torus.

Figure 6:
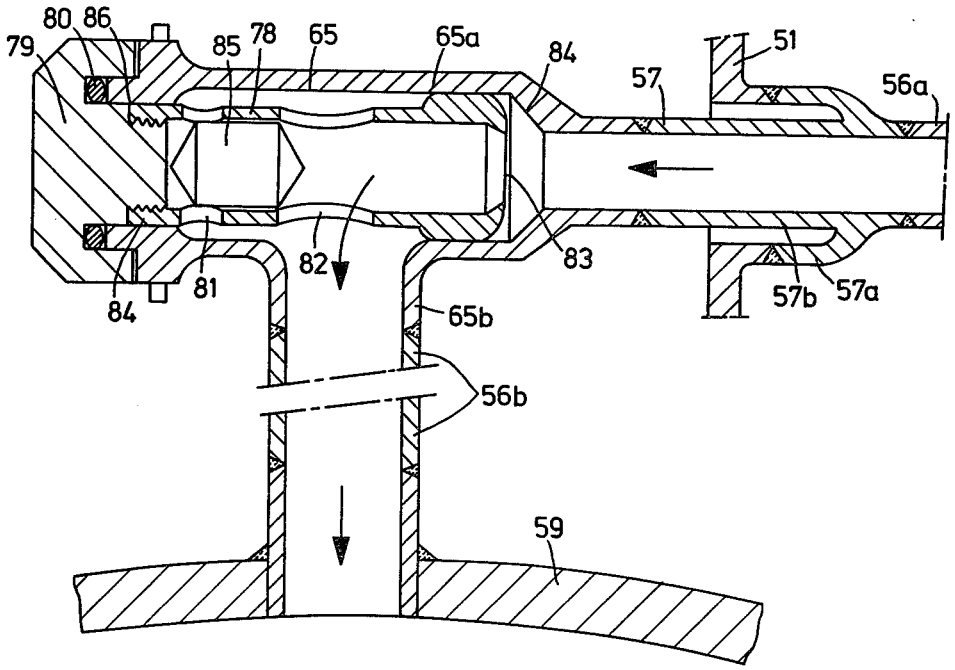

FIG. 6 is a sectional view of the part of the shut-off device associated with the terminal portion of a tube connected to the toric steam collector.

DETAILED DESCRIPTION

Figure 1:
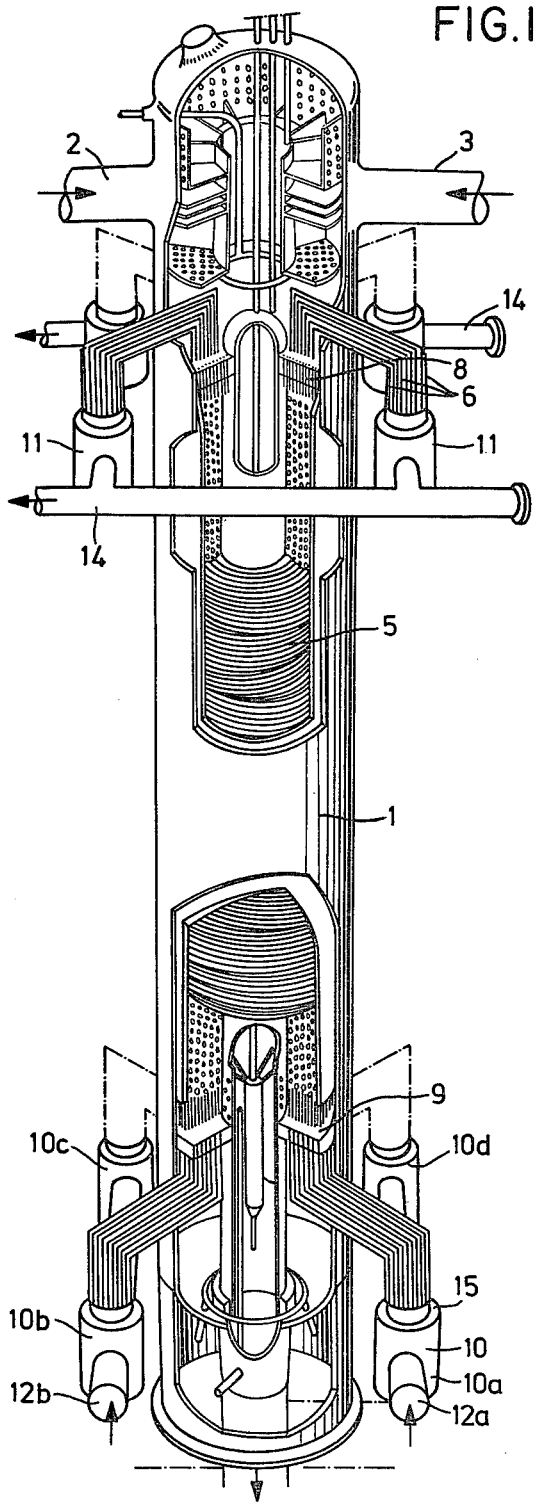
FIG. 1 is a perspective view with portions torn away of a steam generator arranged in the secondary circuit of a fast breeder nuclear reactor comprising feed water boxes and steam collecting boxes.

In FIG. 1, is seen the steam generator which comprises a jacket 1 which is cylindrical and of great height connected at its upper part to inlet pipes 2 and 3 for the secondary liquid sodium heated by the primary liquid sodium in intermediate heat exchanges placed in the secondary circuit of the reactor.

The jacket 1 contains a tube bundle 5 constituted by very long tubes 6 wound in a helix and held in position in the jacket by support grids 8 and 9. The tubes 6 pass through the jacket 1 of the steam generator at its upper part and at its lower part; the terminal portions of each of the tubes 6 are engaged, for this purpose in thermal bushings fixed in the jacket 1.

The feed water flows from below upwards in the tubes 6 of the bundle, each of the tubes being connected to a water box 10 at its lower end and to a steam collector 11 at its upper end, arranged outside the jacket 1.

The set of tubes of the bundle is divided into four sub-sets including the same number of tubes and in which the tubes 6 are connected to the same water box and to the same steam collector, through their terminal portions.

Each of the four water boxes 10*a*, 10*b*, 10*c*, and 10*d* cylindrical in shape, is connected through its side wall to a water feed pipe 12. The tubes 6 of the sub-set connected to the water box are connected to the latter through its flat upper wall constituting a tube plate.

The collectors 11 are connected in pairs to steam delivery pipes 14.

The water flowing from below upwards in the bundle is hence heated by the hot liquid sodium flowing from above downwards in contact with the outer surface of the tubes of the bundle.

The water is evaporated and the steam is collected by the corresponding collector 11.

In FIGS. *2a*, *2b*, *2c*, is seen the flat upper wall 15 of the water box 10 constituting a tube plate in which the lower ends of the tubes 6 are fixed at the level of the bores 16 machined in the tube plate 15.

In the extension of the bore 16 is machined a bore of greater diameter 17 opening into the internal space of the water box.

The inner surface of this bore 17 is tapped over at least part of its height and a threaded bush 18 is fixed by screwing inside this bore 17. The bush 18 is also held inside the water box by means of a spacing plate 20 fixed to the tube plate 15 by means of screws 21 and centered inside the water box by means of wedges 22 of trapezoidal shape.

The bush may be fixed to the plate 20 by welding after positioning.

The tubular bush 18 comprises an inner bore 24 of greater diameter than the bore 16 into which the tube 6 is inserted. The bores 24 and 16 are connected by a passage 25 comprising frustoconic bearing surfaces.

Within the bore 24 is placed a valve 26 including two conical ends joined to a prismatic central portion with a triangular cross-section as shown in FIG. *2b*. The valve 26 is centered inside the bore 24 by the edges of the prism constituting its central part.

The lower end of the valve 26 is fast to a rod 27 positioned along the axis of the bore 24. At its lower part the rod 27 is fixed to a fastening bar 28 engaged in lateral apertures 30 traversing the lateral surface of the bush 18.

The valve 26 is thus held in position as shown in FIG. *2a*, by means of the rod 27.

In this position, the water led into the water box supplies each of the tubes 6 connected to this water box after passage into the bore 24 of the bushes 18 in the direction indicated by the arrows 32. The water may in fact arrive at the bore 16 within which is placed the tube 6, passing around the prismatic body and the conical ends of the valve 26. The rod 27 has sufficient strength to hold the valve in spite of the upwardly directed vertical force exerted by the flowing feed water, when the flow rate of this feed water corresponds to the normal feed flow rate of the tubes 6, during the operation of the steam generator.

In the case of rupture in one of the tubes 6 or of an important leakage in this tube, the flow rate of feed water in this tube passes very rapidly to a very high value, for example ten or twenty times greater than the normal value since this water flows freely into the liquid sodium surrounding the bundle.

The force due to the pressure drop exerted vertically and from below upwards on the valve 26 considerably increases which has the effect of breaking the support rod 27 whose breakage strength has been calculated accordingly. The valve 26 is moved upwards and shuts off the passage 25 in which it is held by the water under pressure filling the inner space of the water box. The water supply of tubes 6 is thus cut off.

In FIG. *3a* is seen the flat upper plate 35 of a collector 11 pierced by a bore 36 in which the upper end of the tube 6 is fixed.

A bush 38 is screwed inside a bore 37 of greater diameter than the bore 36.

The inner bore 34 of the bush 38 of greater diameter than the bore 36 is connected to the latter through a frustoconic bearing surface 40.

The side wall of the bush 38 is pierced by apertures 41 for the exit of the steam (arrows 42).

The lower part of the bush 38 is closed by a wall 43 pierced with a hole 44. On this wall 43 rests a valve 45 closing the aperture 44 and entirely positioned below the apertures 41.

The valve 45 inserted between the apertures 44 on the one hand and 41 on the other hand, comprises two conical ends and a cylindrical central portion.

In normal operation of the steam generator, the steam arriving in the tube 6 passes into the inner chamber of the collector 11 by means of the bore 34 and the apertures 41. The valve 45 remains in centered position inside the lower part of the bush 38 and close the aperture 44.

In the case of a rupture or an important leakage in the tube 6, the pressure drops very rapidly inside the tube 6, the water and the steam escaping into the jacket of the steam generator. The steam under pressure in the collector 11 exerts an upwardly directed vertical force on the valve 45 at the level of the aperture 44.

The valve is propelled to the upper part of the bush 38 and obstructs the passage 40 where it is held by the pressure of the steam in the collector 11.

Immediately after the appearance of a rupture or an important leak in the tube 6, the shut-off device according to the invention enables the production of complete isolation therefore of this tube 6 both with respect to the water box and with respect to the steam collector.

The valves 26 and 45 are held in closed position by the pressurized water of the water box and by the pressurized steam of the collector. In this way the sending of large amounts of water into the liquid sodium filling the jacket of the steam generator is avoided, the period of time elapsing between the appearance of the rupture and the closing of the tube by the valves being extremely brief.

In FIG. 4, is seen a steam generator which comprises like the steam generator shown in FIG. 1, a jacket 51, hot sodium inlets 52 and 53 and a tube bundle 55. The bundle 55 is constituted by tubes 56 of which the lower and upper terminal portions pass through the jacket 51 in thermal sleeves 57.

The terminal portions are connected to the water supply torus and to a steam collector torus 59, respectively. The tori 58 and 59 are arranged outside the envelope 51 and co-axially with the latter.

The steam collector torus 59 is in addition connected to a torus 60 of greater diameter collecting the steam before its transport to the turbine supplied by the steam generator.

The terminal parts of the tubes 56, between the sleeves 57 for passing through the jacket on the one hand and the water supply torus 58 and the steam collector torus 59, respectively, on the other hand, comprise each a connector at T 64 and 65 respectively.

Referring to FIGS. 5 and 6, it is seen that the two parts of the shut-off device are arranged inside the T connectors 64 and 65 inserted in the terminal portions of the tubes 56.

In FIG. 5, is seen the T connector 64 of the terminal portion of a tube 56 connected to the water supply at torus 58. This terminal portion includes the sleeve 57, the connector 64 and the portion of the tube **56*b* welded to the supply torus 58. The sleeve 57 is welded on the one hand to jacket 51 through its portion 57*a* and on the other hand to the connector 64 and to the portion of the tube 56*a* positioned in the jacket 51, by its portion 57*b***.

In the extension of the portion **57*b* of the sleeve 57, the connector 64 includes an aperture 66 closed by a plug 67 fixed to the connector 64, dismountably, by means of a nut 69 screwed on a threaded portion of the connector 64. The aperture 66 permits access to the inlet of the tube 66** into the steam generator.

The connector 64 also includes a branch **64*b* perpendicular to the branch 64*a* extending the portion 57*b* of the sleeve 57 and joined by welding to the portion 56*b* of the tube 56**.

The bush 68 of the shut-off device similar to the device shown in FIGS. **2*a*, 2*b* and 2*c* is fixed to the plug 67 with which it can be mounted on the connector 64. This bush 68 has an outer diameter less than the inner diameter of the branch 64*a* of the connector. At its front end, it has a calibrated aperture 70 bounded by two frustoconic bearing surfaces 70*a* and 70*b*, forming a communication between the bore of the bush with the sleeve 57 and the portion 56*a* of the tube 56 inside the jacket 51** of the steam generator.

The bush 68 also includes aperture 71 in its side wall, facing the branch **64*b*. The front end of the bush 68 is engaged without play in the connector portion 64 ensuring the fastening to the portion 57*b* of the sleeve 57. The water coming from the supply torus 58 through the tube 56*b* and the branch 64*b* hence passes through the connector 64, inside the bush 68** inserted in its path.

Inside the bush 68, a valve 76 is mounted fast to a rupture rod 77 fixed to the plug 67.

The valve 76 has the same shape as the valve 26 shown in FIGS. **2*a*, 2*b* and 2*c*. The rod 77 has sufficient strength to hold the valve 76 against the force exerted by the feed water at its normal flow rate. In the case of leakage, the increased flow rate of the feed water causes the rupture of the rod 77 and the driving of the valve 76 into position of closing the aperture 70*a*-70**.

The maintenance in closed position of the valve 76 is ensured by the pressure of the feed water in the terminal portion of the tube upstream of the aperture **70*a*-70**.

Referring to FIG. 6, the terminal portion corresponding to the upper end of a tube 56 is seen comprising the portion **56*a* of the tube inside the jacket 51 of the steam generator through which the super-heated steam emerges, and sleeve 57, connector 65 and portion 56*b* of the tube 56 connected to the toric steam collector 59**.

At one of its ends, the connector 65 comprises an aperture 86 in the extension of the portion **57*b* of the sleeve 57 and the steam outlet of the tube 56*a* positioned in the jacket 51. The aperture 86 is closed by a plug 79 forming a nut and gripping a fluid type seal 80 to avoid the exit of pressurized super-heated steam. The front portion of the connector 65 welded to the portion 57*b* of the sleeve 57 has an inner diameter less than the inner diameter of the branch 65*a* of the connector. A frustoconic bearing surface 84** ensures the junction between these two portions of the connector.

Figure 3A:
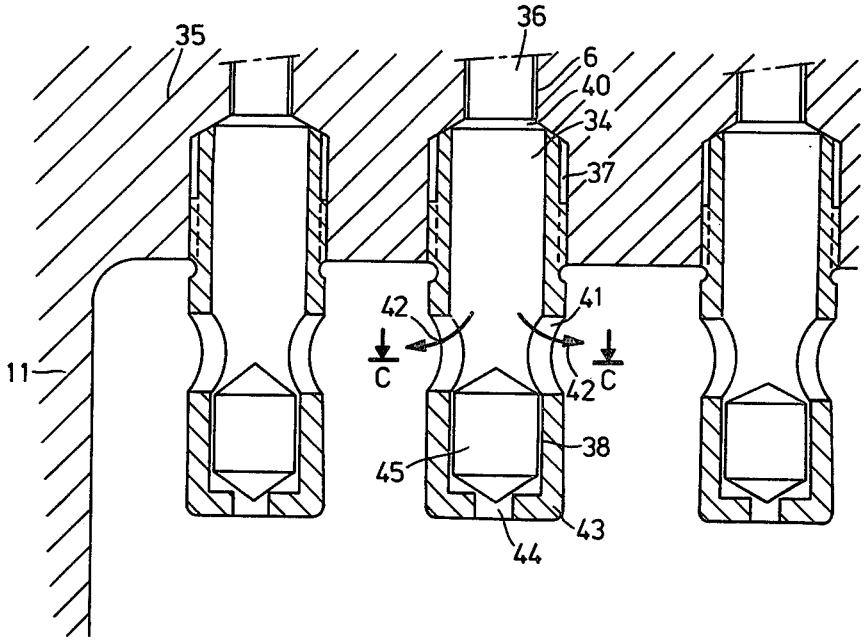
Figure 3B:
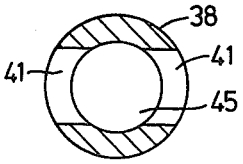

A bush 78 is screwed, through its tapped end 84 to the plug 79. The bush includes a front aperture 83 for steam inlet communicating with the outlet **57*b* of the sleeve 57 and from the tube 56*a* through the conical bearing surface 84. The lateral wall of the bush 78 is pierced by apertures 82 opposite the branch 65*b* and 81 in the vicinity of the plug 79, at the rear portion of the branch 65*a*. A valve 85 similar to the valve 45 shown in FIGS. 3*a* and 3*b* is positioned free and mobile in the bore of the bush 78. This valve 85 is between the apertures 81 and 82 in the position shown in FIG. 6 which corresponds to the opening of the valve 85**.

The front portion of the bush 78 engages without play in the branch 65*a* in the vicinity of the bearing surface 84. The super-heated steam arriving through the tube 56*a* hence penetrates into the bush 78 which is inserted in its path, to re-emerge through the apertures 82, before traversing the tube 56*b* to the steam collector 59.

In the case of a leakage in tube 56, a very sudden pressure drop occurs in the tube 56*a*, the portion 57*b* of the sleeve 57 and the front portion of the bush 58. The steam pressure in the collector 59, the tube 56*b* and the connector 65 continues to be exerted on the rear portion of the valves 85, through the apertures 81. The valve 85 is hence propelled forwards until it shuts off the aperture 83 by being urged onto the frustoconic bearing surface 84. The valve 85 is held in its closed position by the steam pressure in the collector.

In the case of a leakage in a tube 56, the device hence enables immediate and automatic shut-off of this tube.

It is seen that the principal advantages of the device according to the invention are to enable the introduction of water into the secondary circuit of the nuclear reactor to be avoided, in the case of rupture of a tube of the steam generator bundle, by using extremely simple devices and not requiring any control means and any monitoring device.

The invention is in no way limited to the embodiment which has just been described; it comprises on the contrary, all modifications.

Thus there may be imagined rupture parts different from a rod for holding the valve in open position in the bushes associated with the water supply device or at the terminal portion of the corresponding tubes.

It is also possible to conceive a valve of different shape and any sort of means for fastening the bushes.

Instead of valves with free displacement arranged in the inner bore of the bushes associated with a steam collector, it is possible to conceive the use of valves with a return device.

It is quite obvious that the shut-off device which has just been described relates to a single tube but that each of the tubes of the bundle is equipped with a similar device comprising closure means at each of its ends.

The emergency shut-off device according to the invention is applicable whatever the number of water boxes and the number of steam collectors associated with the steam generator. It applies equally in the case of all collectors of toric or other shape to which are connected the terminal portions of the tubes.

The device applies also in the case of steam generators comprising a device for supplying or recovering steam in the form of a box, for example cylindrical, and a device for the recovery of steam or feed water, respectively, in the form of a toric duct.

I claim:

1. Emergency shut-off device in the case of leakage of a tube of a steam generator comprising a jacket containing a tube bundle, within which a liquid metal circulates in contact with the outer surface of tubes of the bundle and applies the heat of vaporization to feed water circulating in each of the tubes two terminal of which portions pass through the jacket and are connected, one to a water supply device and the other to a collector collecting steam formed in the tube, arranged outside the jacket, said device comprising:

in the terminal portion of the tube connected to the water supply device, a tubular bush inserted in the path of the feed water between the supply device and a portion of the tube entering the jacket, comprising inlet and outlet apertures for the water and containing a valve connected to the bush by a breakable part, in the case of puncture of the breakable part manifested by increased flow rate of water through the bush, said valve being driven into a position of closing the feed water outlet, of the bush, and in the terminal portion of the tube connected to the steam collector, a second tubular bush inserted in the path of the steam between the jacket of the steam generator and the steam collector, comprising inlet and outlet apertures for the steam and containing a valve free and movable in the bore of the bush, between an open position where the valve is placed between two sets of apertures, for passage of steam communicating with the steam collector and a closed position of the inlet aperture of the steam into the bush, by movement under the effect of a pressure difference appearing between the inner space of the steam collector and the inside of the bush, in the case of a leakage in the tube.

2. Emergency shut-off device according to claim 1, wherein the steam generator is supplied with water and steam is recovered by boxes, and wherein the bushes are fixed in the wall of the box receiving the tube, so that the bore of the bush communicates, at one of its ends, with a bore provided in the wall and receiving the end of the tube and at its other end with the inner space of the box.

3. Emergency shut-off device according to claim 1, wherein the steam generator is supplied with water and steam is recovered through toric ducts each tube connected at its ends to the toric ducts comprising a T connector in each of its terminal parts, and wherein the bush is arranged in one of the branches of the T connector, for each of the terminal parts of the tube.

4. Shut-off device according to any one of claims 1, 2 and 3, wherein the valve arranged inside the bush associated with the terminal portion of the tube connected to the water supply device comprises a closure end of conical shape and a guide portion in a bore of the bush of prismatic shape and wherein the valve is connected through its end opposite the closure end to a rupture rod arranged along the axis of the bore of the bush and connected through its opposite end to the end connected to the valve at the bush.

5. Shut-off device according to claim 2, wherein the bush associated with the water box is held in position in the latter, at its end opposite the end fixed in the wall of the water box by a holding plate pierced with apertures for engagement of the end of the bushes corresponding to the set of tubes connected to the water box.

6. Shut-off device according to claim 2, wherein the bush connected to the steam collector is arranged with its axis vertical and includes a part engaged in a horizontal wall of the steam collector and a part projecting inside the inner chamber of the steam collector closed by a bottom including a central aperture on which rests the valve in open position, at least one aperture traversing the lateral wall of the projecting portion of the bush, above the valve, for the exit of the steam in the inner space of the collector.

* * * * *